US009787019B2

(12) United States Patent
Andre et al.

(10) Patent No.: US 9,787,019 B2
(45) Date of Patent: Oct. 10, 2017

(54) ELECTRICAL CONNECTOR WITH A MOBILE SKIRT

(71) Applicant: MOLEX INCORPORATED, Lisle, IL (US)

(72) Inventors: Marcel Andre, Moissy Cramayel (FR); Stephane LaFaure, Chateauneuf en Thymerais (FR); Philippe Beugnot, Voisins le Bretonneux (FR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/032,184

(22) PCT Filed: Oct. 29, 2014

(86) PCT No.: PCT/IB2014/002961

§ 371 (c)(1),
(2) Date: Apr. 26, 2016

(87) PCT Pub. No.: WO2015/063601

PCT Pub. Date: May 7, 2015

(65) Prior Publication Data

US 2016/0268725 A1 Sep. 15, 2016

(30) Foreign Application Priority Data

Oct. 29, 2013 (FR) ..... 13 02495

(51) Int. Cl.
*H01R 13/52* (2006.01)
*H01R 13/516* (2006.01)
*H01R 43/26* (2006.01)

(52) U.S. Cl.
CPC ..... *H01R 13/5219* (2013.01); *H01R 13/516* (2013.01); *H01R 43/26* (2013.01)

(58) Field of Classification Search
CPC ..... H01R 13/5219; H01R 13/5221; H01R 13/5208; H01R 13/5216; H01R 13/5205; H01R 33/9651; H01R 13/53
USPC ..... 439/271–276, 278–283
See application file for complete search history.

(56) References Cited

U.S. PATENT DOCUMENTS 5,248,263 A 9/1993 Sakurai et al.
6,280,220 B1 * 8/2001 Horner ..... H01R 13/5208 174/153 G
6,325,669 B1 * 12/2001 Safai ..... H01R 13/5208 439/274

(Continued)

*Primary Examiner* — Phuong Chi T Nguyen
(74) *Attorney, Agent, or Firm* — Clarence R. Moon

(57) ABSTRACT

An element making up the body of an assembly providing a connection, consisting of a first element making up the connection module (1) and a second element making up the body (2); the module comprising a lower housing (4) destined to be received in a lower housing or at the body base (5) to make the connection; an elastomeric inter-housing gasket intended to form a seal between the lower housing and the base set on the module's lower housing upper edge rim, and a ring (9) making up a skirt that is set to be removable in the direction of insertion of the module into the base around the module; the skirt, which can be placed in such a way as to cover the gasket, and in such a way as to leave the gasket exposed, wherein the body comprises the translation means intended to allow the ring making up the skirt to move into the position where it will not cover the gasket when the module is inserted into the body.

15 Claims, 10 Drawing Sheets

(56) References Cited

U.S. PATENT DOCUMENTS

| | | | | |
|---|---|---|---|---|
| 7,044,762 | B1 | 5/2006 | Hong et al. | |
| 7,077,676 | B2 * | 7/2006 | Matsumoto ..... | H01R 13/5205 439/271 |
| 7,249,958 | B2 * | 7/2007 | Ishikawa ..... | H01R 13/631 439/140 |
| 7,427,209 | B2 | 9/2008 | Bouchan et al. | |

* cited by examiner

ELECTRICAL CONNECTOR WITH A MOBILE SKIRT

RELATED APPLICATIONS

This application claims priority to French Application No. 13/02495, filed Oct. 29, 2013, and to International Application No. PCT/IB2014/002961, filed Oct. 29, 2014, both of which are incorporated herein by reference in their entirety.

TECHNICAL FIELD

The present invention relates to a connection assembly having a piece making up a base and a part making up a module intended to be inserted in the base to provide an electrical connection. The present invention also relates to a module in an assembly of this kind, as well as a base of an assembly of this kind.

SUMMARY OF THE INVENTION

In assemblies of this kind from the prior art, it was agreed that the module has an inter-housing gasket on its rim made of elastomeric material, intended to seal the electrical connection at the interface between the base and the module.

It was necessary to protect this inter-housing gasket made of elastomeric material prior to its insertion into the base, because the module is subject to repeated handling and/or carrying, which may damage this elastomeric inter-housing gasket.

The fact of surrounding the inter-housing gasket with a removable protection ring, which, when the module is inserted to engage with the base, can be raised to reveal the elastomeric inter-housing gasket is already known from the prior art, particularly from EP 1903641. However, these assemblies from the prior art are particularly complicated to manufacture, and, in particular, the module comprises a lever system that allows to simultaneously raise the skirt and connect the module lower housing and the base.

The present invention aims to overcome the prior art's assemblies drawbacks by providing a connection assembly of the kind mentioned above, which is simpler to manufacture and easier to use.

According to the invention, an assembly providing a connection is such as specified in claim 1.

Positioning the module in the body is thus significantly simplified, since it is now no longer necessary to provide a lever system on the module that needs to be activated after having previously inserted the module into the body. The user simply takes the module and drives it into the body, the means by which it moves automatically ensuring now the raising of the skirt when the lower housing is driven into the base. Manufacturing the module is also significantly simplified since it would no longer be necessary to make or add a particularly complex lever.

According to another embodiment of the invention, the translation means are such that when the module is removed and no longer engaged with the body, the protection ring does not lower down again and the inter-housing elastomeric seal remains exposed.

According to a preferred embodiment of the invention, the translation means comprise at least one hook that extends inside the body and forms a stop to a rib of a flexible piece of the protection ring outer face.

According to a preferred embodiment of the invention, the translation means comprise at least one hook from the module, and at least one slot on the protection ring, the arrangement being such that the hook passes through the slot, the slot extends in the direction of insertion, and the shapes and dimensions of the hooks and the slot are such that at least one hook can move into the slot until it rests against the slot's lower edge.

According to a preferred embodiment of the invention, the body comprises at least one opening to receive said rib at least, and also a hook placed just above the opening.

The present invention also relates to an element forming an assembly module according to the invention, as well as an element making up the body of an assembly according to the invention.

According to the invention, an element making up the module of an assembly providing a connection, consisting of a first element making up the connection module and a second element making up the body, the module comprising a lower housing designed to be received in a lower housing or at the body base to make the connection; an elastomeric inter-housing gasket intended to form a seal between the lower housing and the base set on the module's lower housing upper edge rim, and a ring making up a skirt that is set to be removable in the direction of insertion of the module into the base around the module; the skirt, which can be placed in such a way as to cover the gasket, and in such a way as to leave the gasket exposed, wherein at least one hook from the module is provided, and at least one slot is formed on the protection ring, the arrangement being such that the hook passes through the slot, the slot extends in the direction of insertion, and the shapes and dimensions of the hooks and the slot being such that at least one hook can move into the slot until it rests against the slot's lower edge.

According to the invention, an element making up the body of an assembly providing a connection, consisting of a first element making up the connection module and a second element making up the body; the module comprising a lower housing destined to be received in a lower housing or at the body base to make the connection; an elastomeric inter-housing gasket intended to form a seal between the lower housing and the base set on the module's lower housing upper edge rim, and a ring making up a skirt that is set to be removable in the direction of insertion of the module into the base around the module; the skirt, which can be placed in such a way as to cover the gasket, and in such a way as to leave the gasket exposed, wherein the body comprises the translation means intended to allow the ring making up the skirt to move into the position where it will not cover the gasket when the module is inserted into the body.

BRIEF DESCRIPTION OF THE DRAWINGS

For example, a description is now given of the preferred embodiments of the invention referring to the drawings where.

DETAILED DESCRIPTION OF THE PREFERRED EMBODIMENTS

Figure 2:
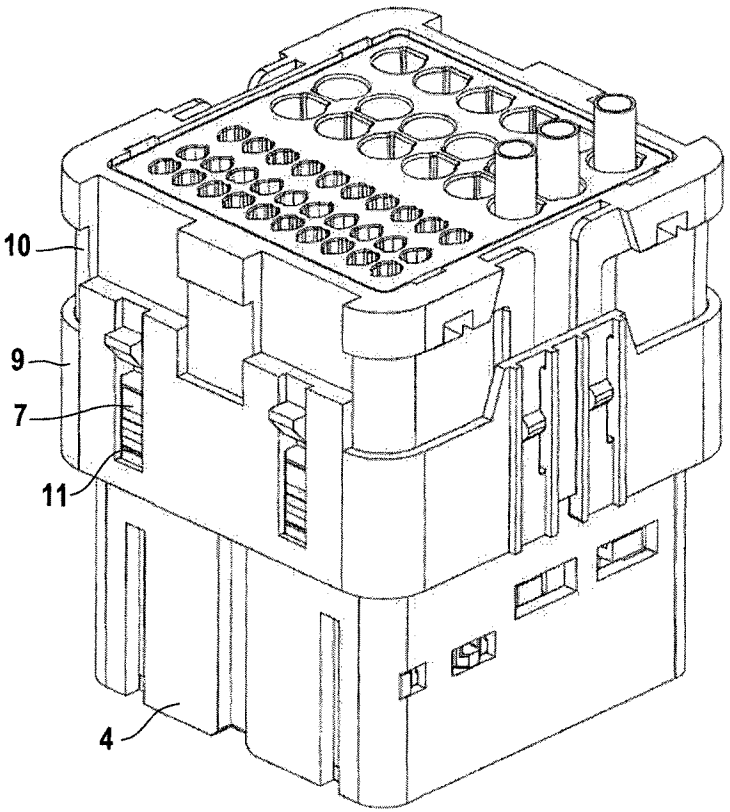
FIG. 2 is a perspective view of the assembly module in FIG. 1 showing the ring or protection skirt covering the elastomeric inter-housing gasket.

FIGS. 1 to 8 show a first embodiment of an assembly according to the invention. The connection assembly comprises a first element, generally referred to as module 1, which is intended to be inserted into a second connection element 2, referred to as the body. Connection module 1 has a top part in the shape of a rectangular parallelepiped enclosing a gap 3, intended to receive the connection terminals. Module 1 further comprises a bottom part 4 also in the shape of a rectangular parallelepiped housing, intended to allow the passage of all the terminals pins connecting to the body base. The bottom part 4 is intended to be received at the body 2 base 5. The bottom part 4 and top part 3 of module 1 are separated by an intermediate part, which is completely surrounded by an elastomeric seal 7. This elastomeric seal 7 is intended, when module 1 is inserted completely in the body 2, to form a tight seal between the housing corresponding to the module 1 bottom part 4 and the base 5.

Figure 1:
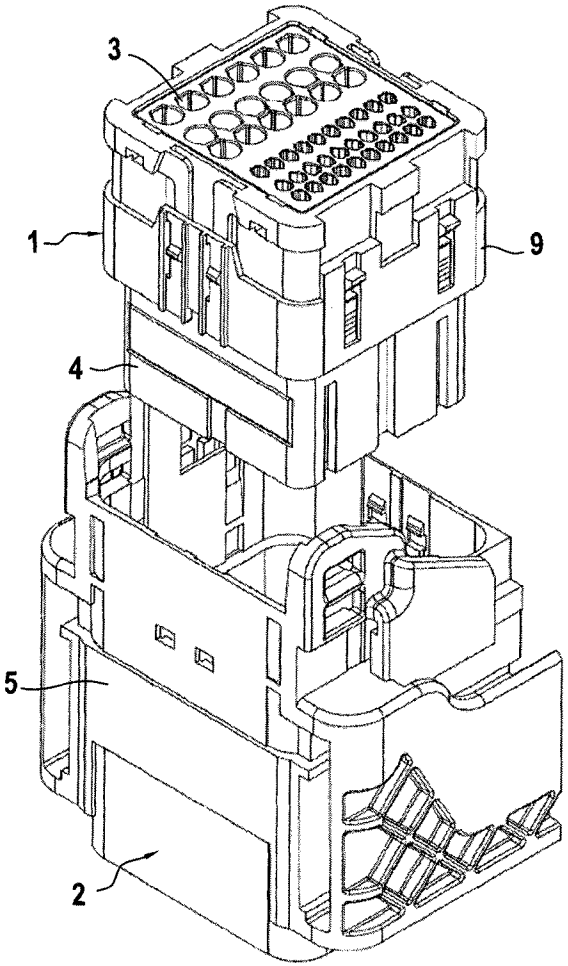
FIG. 1 is a perspective view of an assembly according to the invention consistent with a first embodiment.
Figure 4:
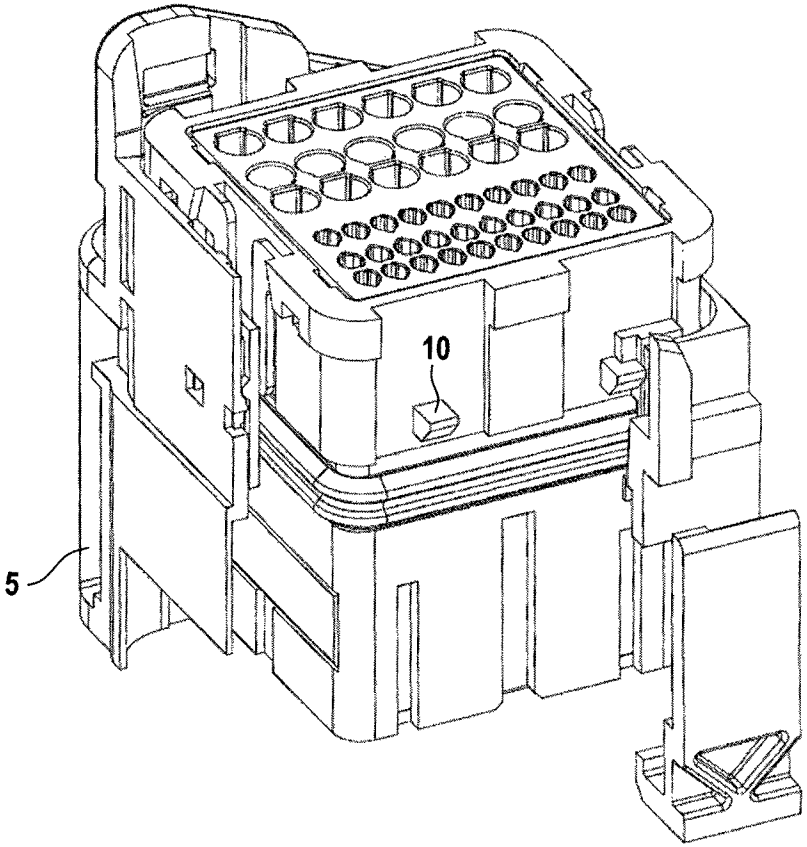
FIG. 4 is a perspective view of the assembly in FIG. 1, partially pulled off, in an intermediate position upon insertion of the module into the body.
Figure 3:
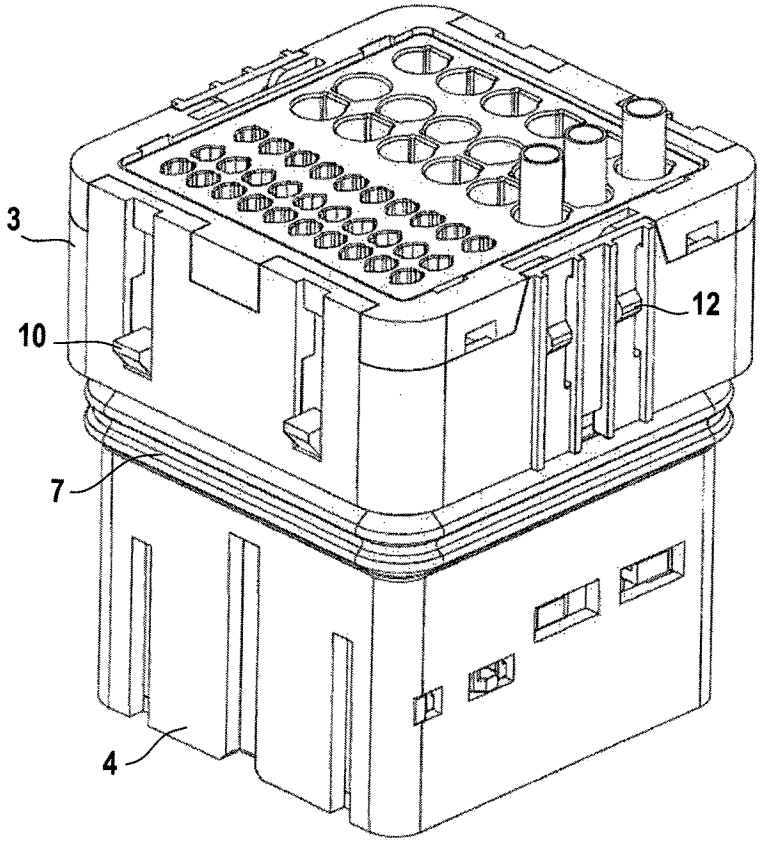
FIG. 3 shows the module in FIG. 2 the way it is when fully inserted in the base, with the ring or protection skirt moved upward so as to expose the inter-housing gasket.
Figure 4B:
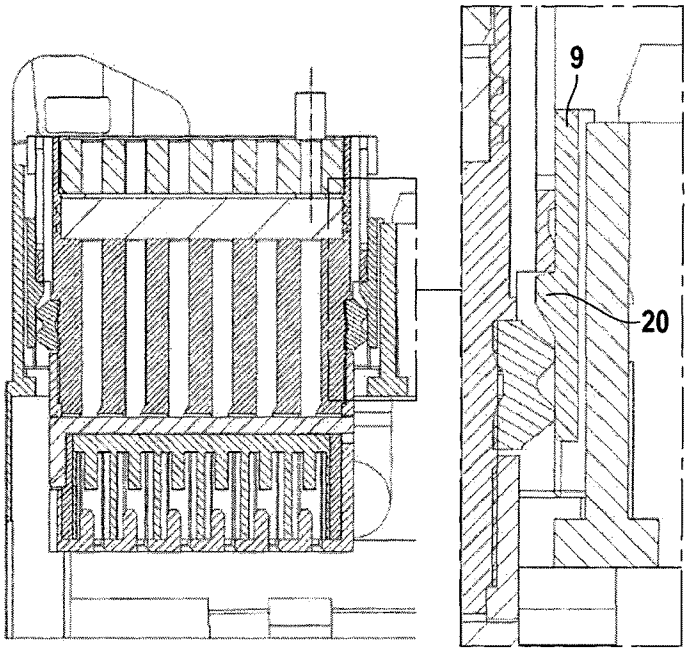
FIG. 4*b* is a cross-sectional view of part of FIG. 4, showing the interaction, in the intermediate position upon insertion of the module, between the module skirt and the upper part of the module.
Figure 4A:
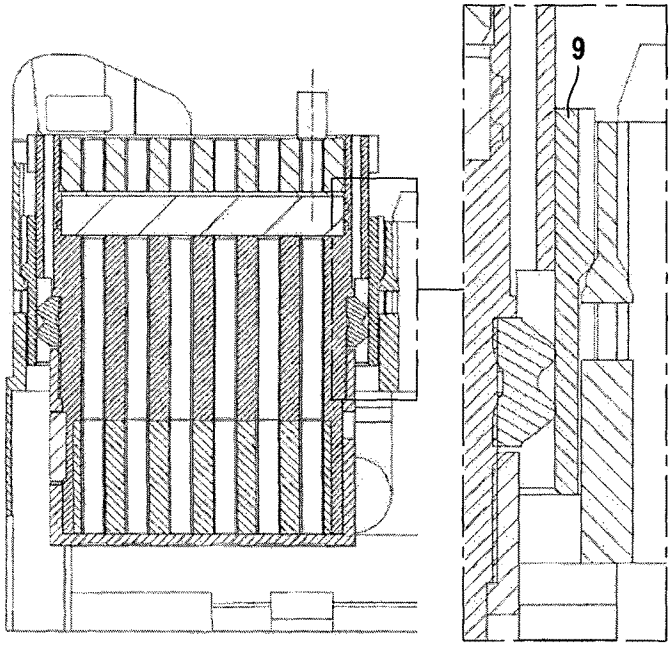
FIG. 4*a* is a cross-sectional view of part of FIG. 4, showing the interaction, in the intermediate position upon insertion of the module, between the module skirt and the upper body wall 2.
Figure 6:
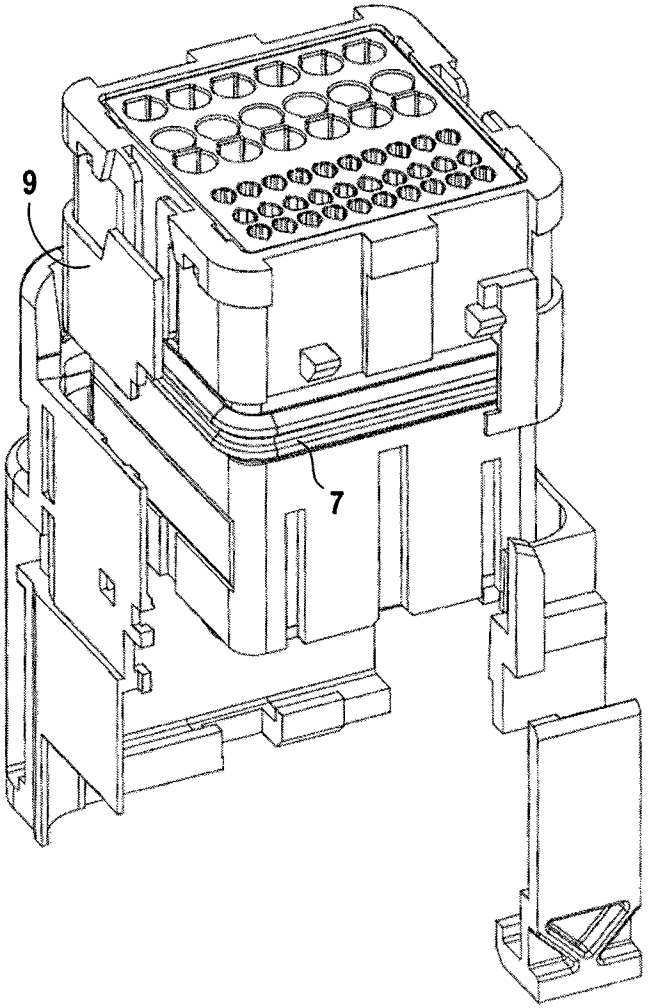
FIG. 6 is a perspective view, partially pulled off, of assembly in FIGS. 1, 4 and 5, in a position in which the module's translation towards the base follows a downward direction (direction of insertion) in relation to the position in FIGS. 5.

A cross-sectional ring element 9 corresponding to the module's cross-section, preferably completely surrounds the module to protect the inter-housing gasket 7 against the outside. This ring element 9 is assembled to be removable relative to the module in the vertical direction, that is, the direction perpendicular to the gasket cross-section. The hooks 10 projects laterally outwardly from the outer surface of module 1, and in particular from the top part 3. Hooks are particularly provided on the front side (as shown in FIG. 1), and the back side (not shown in the figure). However, hooks could also be provided on one side only. It is shaped into the thin element 9 protecting the slots 11 projecting in the vertical direction defined above. The width of the slots 11 correspond to the hooks 10 dimensions, so that when the protection element 9 moves upwards, the hooks pass through the slots 11 and allow the relative upward movement of the protection ring 9, with respect to the position shown in FIG. 1.

At the end of the protection ring 9 (see FIG. 3) upward movement, each slot 11 lower edge rests against the hook 10 bottom part, and prevents any further upward movement of the protection ring 9. In the position in which the slot 11 lower edge rests against the hook 10, the protection ring is raised so that it no longer protects the inter-housing gasket 7, which is thereby exposed.

Pins 12 extend from a flexible piece on the side of the protection ring 9.

The body 2 is also substantially rectangular parallelepiped in shape, a shape essentially complementary to that of the module, which encloses within a space to receive the module. The bottom body 2 part, known as the base 5, is intended to receive the module 1 bottom part 4, the bottom part 4 in which the pins for the electrical connection are located. When the bottom part 4, shaped as a rectangular parallelepiped, is received in the base part 5, the inter-housing gasket 7 forms a tight seal at the interface between the two housings.

Two windows 13 are formed on the body 2 side wall, on the top part destined to connect with the module 1 top part when the latter is fully inserted in the body 2. At least one ridge 18 projects from the inner side of the body 5, preferably approximately just above the windows 13.

Figure 5:
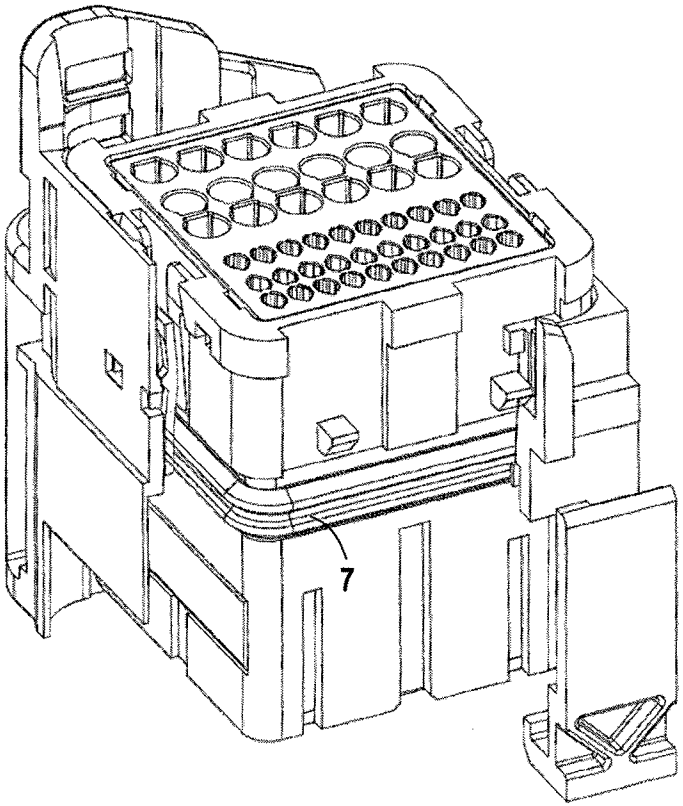
FIG. 5 is a perspective view, partially pulled off, of the assembly in FIGS. 1 and 4, in a position in which the module's translation toward the base follows a downward direction (direction of insertion) in relation to the position in FIG. 4.
Figure 5B:
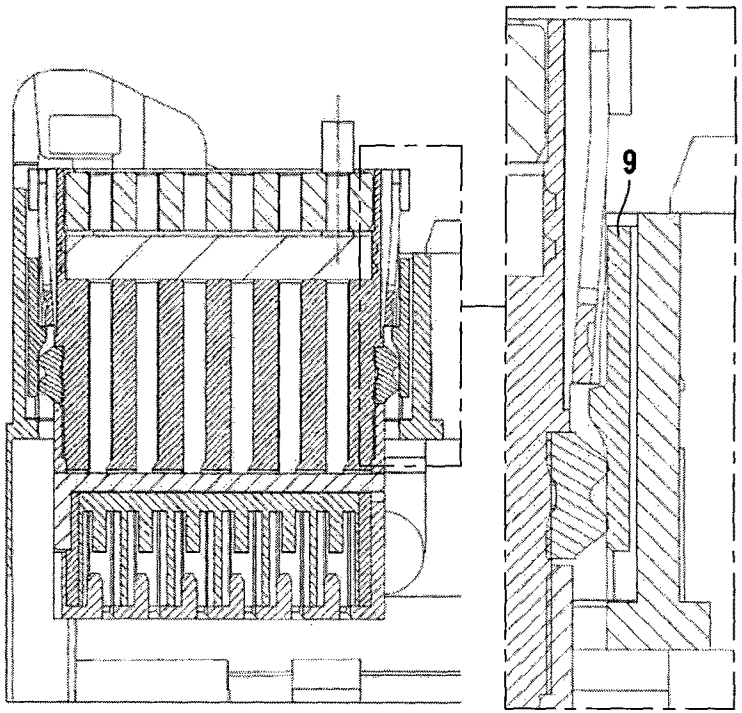
FIG. 5*b* is a cross-sectional view of part of the assembly in FIG. 5, showing the interaction, in an intermediate position upon insertion of the module, between the module skirt and the upper part of the module.
Figure 5A:
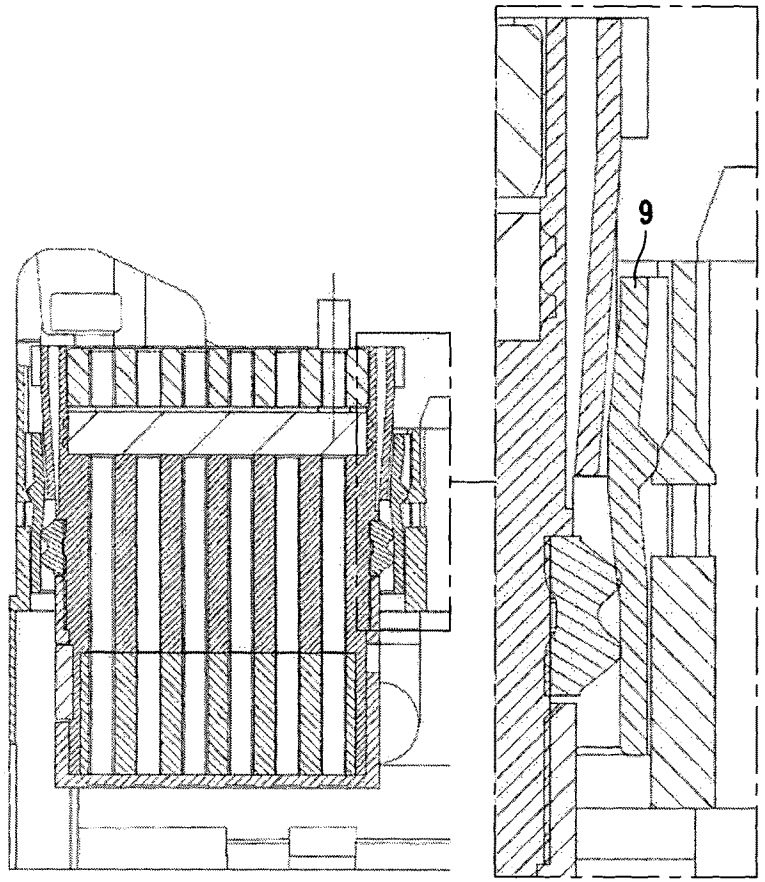
FIG. 5*a* is a cross-sectional view of part of the assembly in FIG. 5, showing the interaction, in an intermediate position upon insertion of the module, between the module skirt and the upper body wall 2.
Figure 6B:
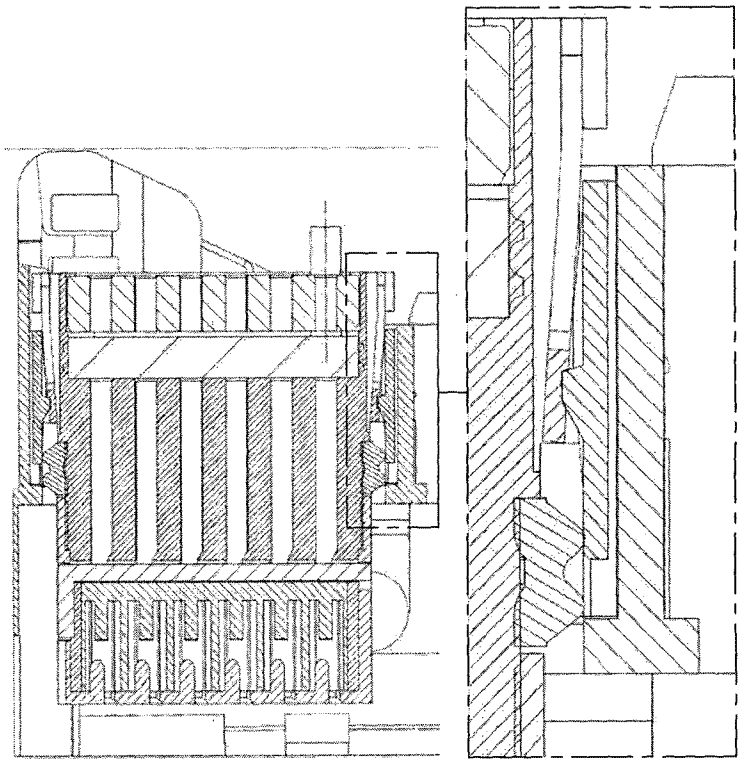
FIG. 6*b* is a cross-sectional view of part of the assembly, showing the interaction, in an intermediate position according to the position in FIG. 5 upon insertion of the module, between the module skirt and the upper part of the module.
Figure 6A:
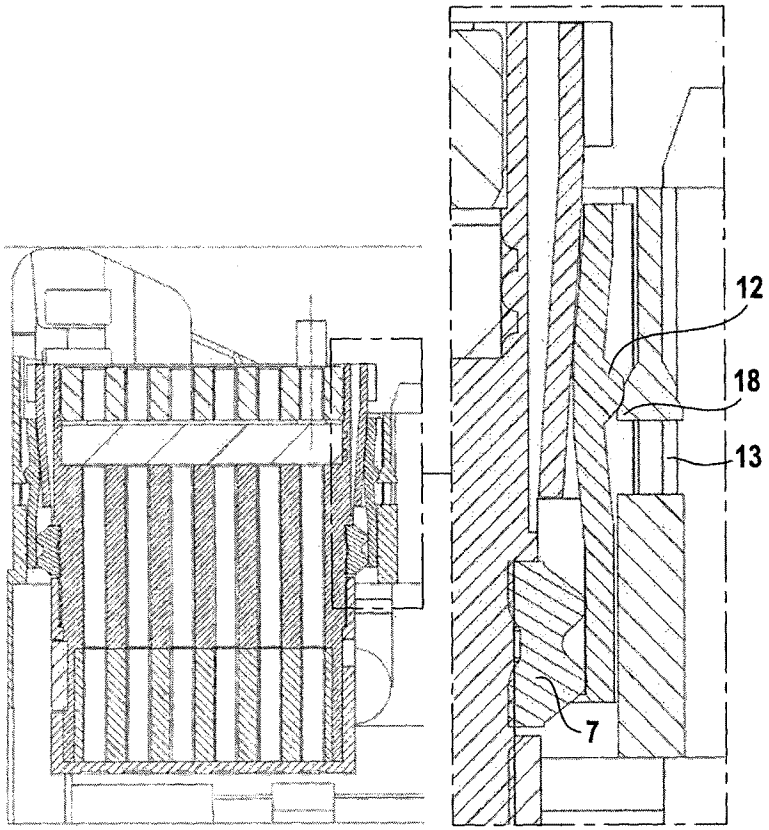
FIG. 6*a* is a cross-sectional view of part of the assembly, showing the interaction, in an intermediate position according to the position in FIG. 5 upon insertion of the module, between the module skirt and the upper body wall 2.
Figure 8:
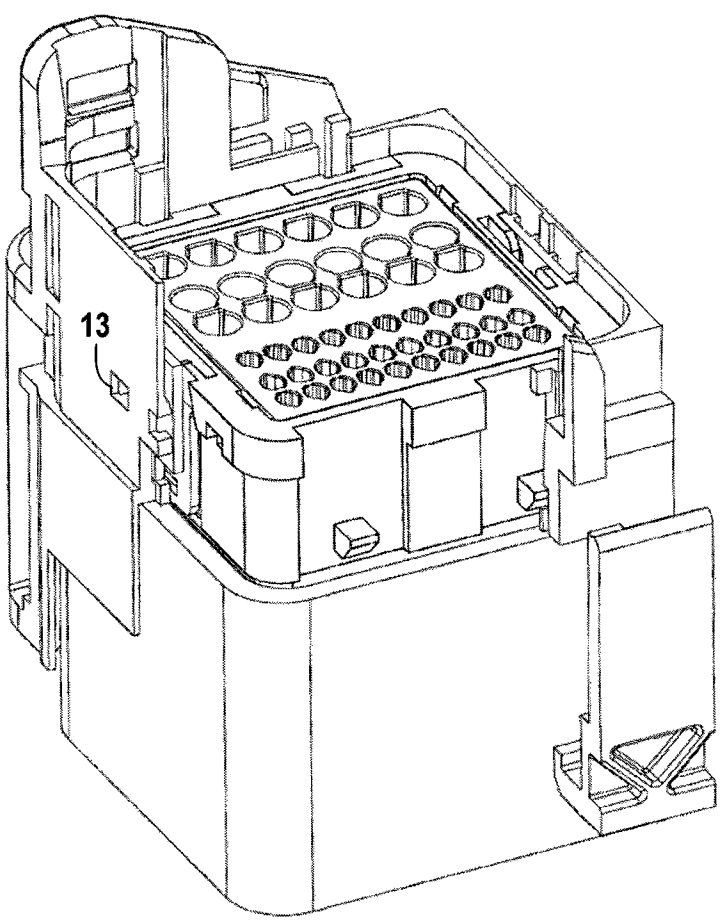
FIG. 8 is a perspective view, partially pulled off, of assembly in FIGS. 1, 4 and 5-7, in a final position according to the position in which the module's translation towards the base follows a downward direction (direction of insertion) in relation to the position in FIG. 7.
Figure 7:
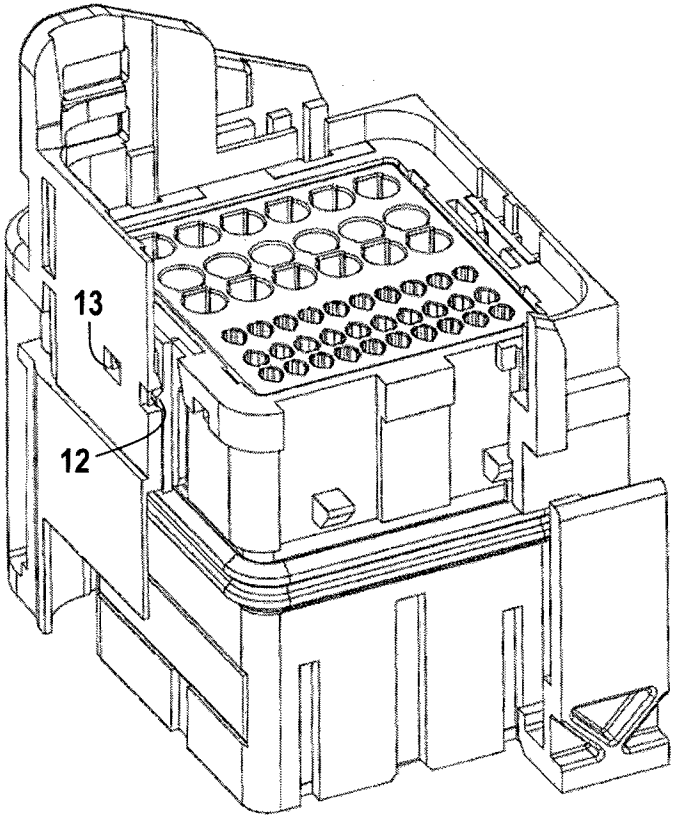
FIG. 7 is a perspective view, partially pulled off, of the assembly in FIGS. 1, 4 and 5, in a position in which the module's translation toward the base follows a downward direction (direction of insertion) in relation to the position in FIGS. 6*a* and 6*b;*
Figure 7B:
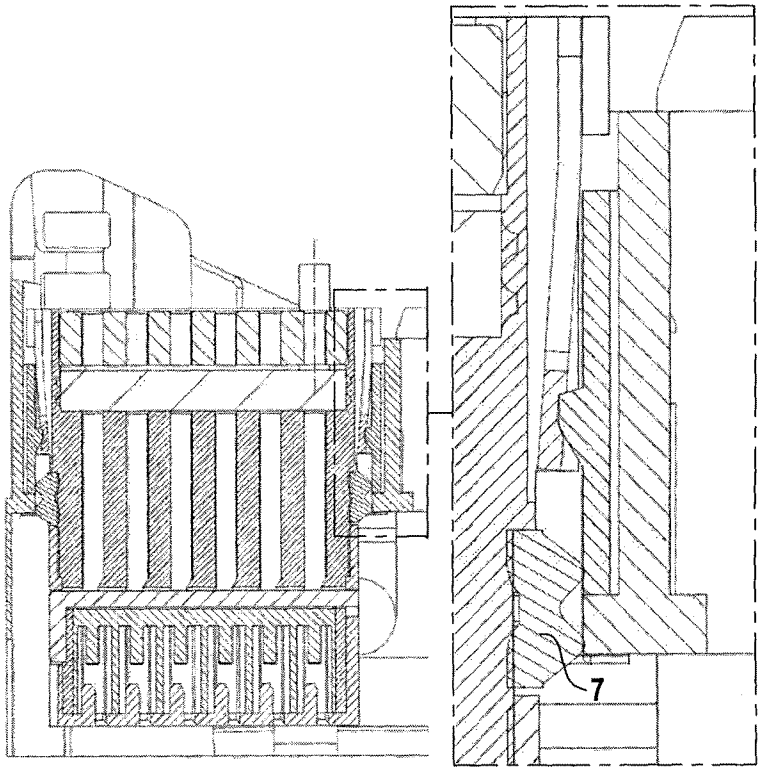
FIG. 7*b* is a cross-sectional view of part of the assembly in FIG. 5, showing the interaction, in an intermediate position upon insertion of the module, between the module skirt and the upper part of the module.
Figure 7A:
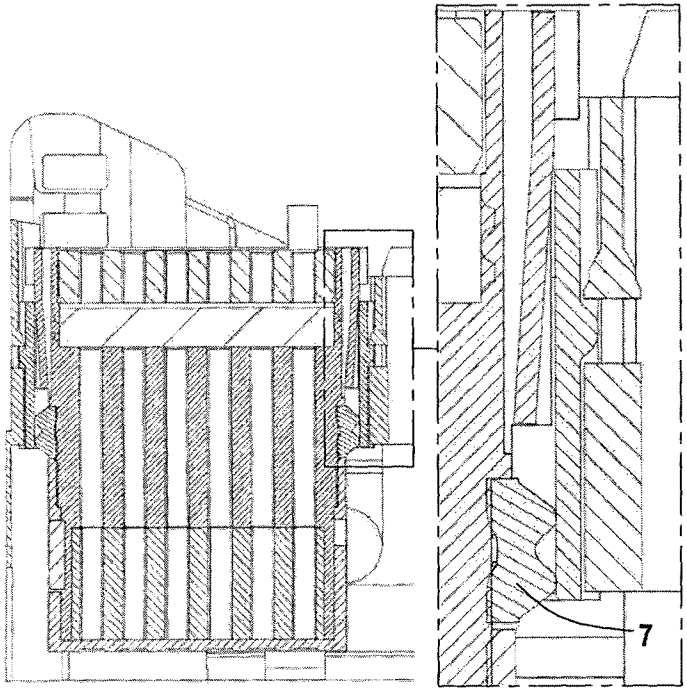
FIG. 7*a* is a cross-sectional view of part of the assembly in FIG. 7, showing the interaction, in an intermediate position upon insertion of the module, between the module skirt and the upper body wall 2.
Figure 8B:
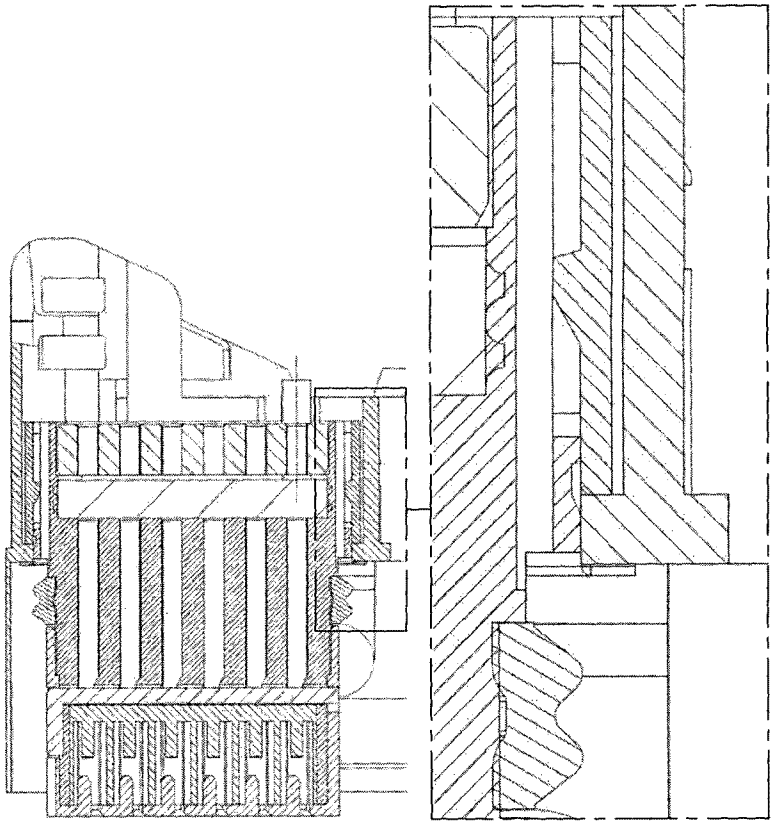
FIG. 8*b* is a cross-sectional view of part of the assembly, showing the interaction, in a final position according to the position in FIG. 5 upon insertion of the module, between the module skirt and the upper part of the module.
Figure 8A:
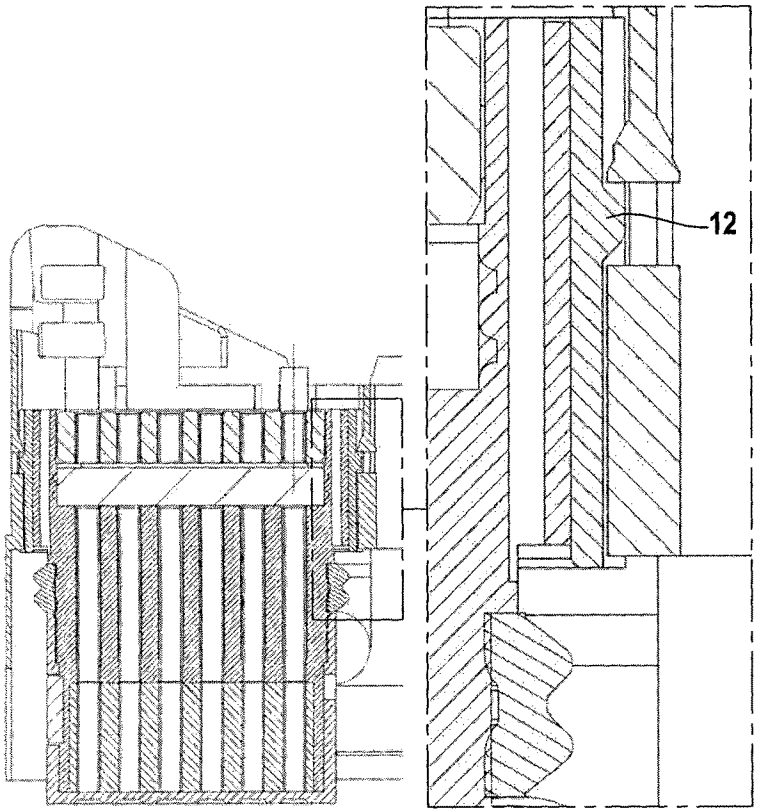
FIG. 8*a* is a cross-sectional view of part of the assembly, showing the interaction, in a final position according to the position in FIG. 7 upon insertion of the module, between the module skirt and the upper body wall 2.

The insertion of module 1 in the connected position into the body 5 base 2 takes place sequentially, as defined by the passage from FIG. 1 to FIGS. 4, 4*a* and 4*b*, then to FIGS. 5, 5*a* and 5*b*, then to FIGS. 6*a* and 6*b*, following to FIGS. 7, 7*a* and 7*b*, and finally to FIGS. 8*a* and 8*b*.

In FIG. 1, the module is still away from the body 2 and the protection element 9 surrounds and protects the inter-housing gasket 7. The insertion of the module into the interior space enclosed by the body 2 continues in the vertical downward direction until the pins 12 from the flexible piece of the element 9 part rest against the ridges 18 from the inner side of the body 2. This is then the position shown in FIGS. 4, 4*a* and 4*b*.

The protection skirt 9 always protects the gasket 7, and the hooks 10 are always against the upper edge of the respective slots 11. In this intermediate position shown in FIG. 4, the movement of the protection skirt is thus stopped. In addition, a pin 20 from the inner side of the ring 9 rests against a module wall 21.

Module 2, always connected to the ring 9, continues lowering down, and the pin 12 pressing against the ridge 18 elastically deforms the module wall 21, thereby releasing the module from the ring 9, as shown in FIGS. 5, 5A and 5B. Module 2 then continues lowering down, but does not carry the ring 9 with it, the ring remaining locked by means of the pin 12 and the ridge 18. The result is a downward translation of the hooks 10 into the slot 11, since the skirt, blocked by means of the ridges 18 and the pins 12, no longer moves, the module being connected to the hooks 10. This downward translation continues until the hooks 10 rest against the slots 11 lower edge. This is then the position shown in FIGS. 6*a* and 6*b*, wherein the inter-housing elastomeric gasket 7 is completely exposed, the skirt 9 has been fully raised and the lower housing 4 is essentially inserted into the body 2 lower housing 5. A final push on the module causes the pin 12, thanks to the flexibility of the piece of the skirt from where it comes from, to go beyond the ridge 18 and to come in contact with the window 13. The protection ring flexible piece is then returned to its initial position, tending to move the pins outwardly and thus maintaining them in the windows 13, ensuring the perfect positioning of the module in the base with the gasket in position, as shown in FIGS. 8*a* and 8*b*.

Figure 11:
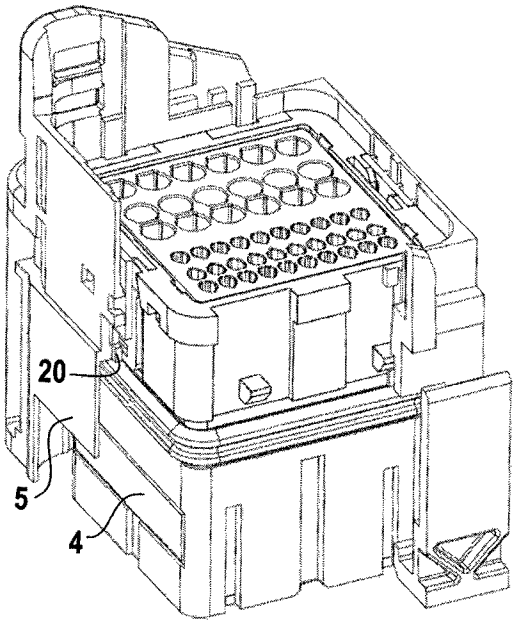
FIG. 11 is a perspective view of the assembly in FIGS. 9 and 10, in the position in which the module is in electrical connection with the body base, and the elastomeric seal provides the sealing function.
Figure 10:
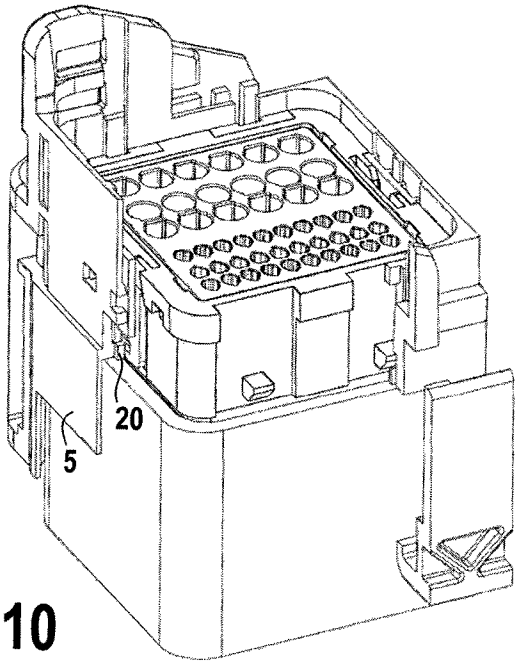
FIG. 10 is a perspective view, partially pulled off, of the assembly in FIG. 6, wherein the module has started to lower down into the body.
Figure 9:
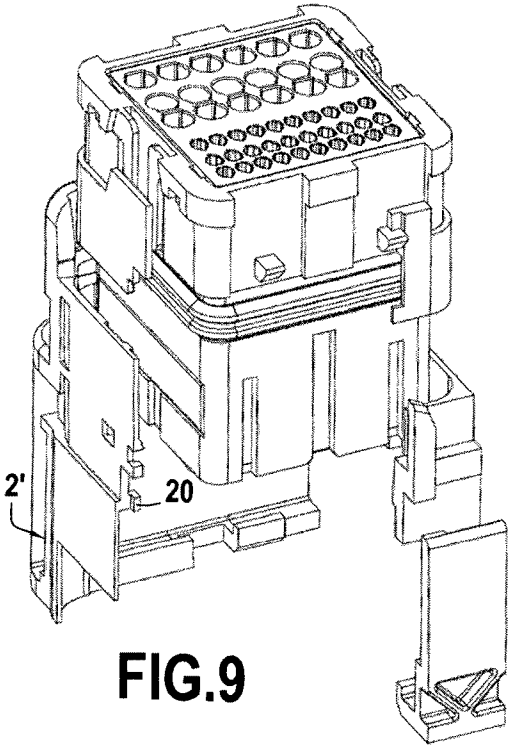
FIG. 9 is a perspective view, partially pulled off, of an assembly forming an electrical connector according to a second embodiment of the invention wherein the module is at a distance from the body.

FIGS. 9 to 11 show a second embodiment of the invention.

Compared to the embodiments of FIGS. 1 to 8, module 1' is identical to module 1, except for the ring-shaped protection skirt. In the embodiment of FIGS. 9 to 11, the protection skirt has no flexible piece capable of being deformed under the effect of pressure or of the corresponding pins 13.

In relation to the base 2' of the embodiments of FIGS. 9 to 11, the base is essentially identical to that of FIGS. 1 to 8. However, the difference is that a hook is provided, which projecting inwardly, essentially at the level delimiting the body base.

As shown in FIGS. 9 to 11, when the module is inserted into the base, the protection skirt surrounds the inter-housing gasket. In FIG. 10, the translation reaches a point wherein the lower edge of the protection skirt rests against the housing 2' hook 20, stopping then the ring downward movement. In contrast, the module, mounted to be removable with respect to the ring, as in the prior embodiment, continues moving down until the module lower housing 4 goes inside the lower housing 5 or the body 2' base 5. In the final position shown in FIG. 11, the translation ended when the bottom housing 4 was perfectly placed on the body or base 5 bottom housing 5. The gasket performs its sealing function to perfection.

It should be noted that in this second embodiment, when the module needs to be removed from the base, the protection ring does not go back to the position where the seal is protected; instead, the gasket remains visible or exposed. On the other hand, in the embodiment of FIGS. 1 to 8, when the module is raised to be removed from the body of, the protection ring returns to its position to protect the gasket against the outside by the reverse action of the hooks 13 and pins, with respect to their action during the downward translation.

The invention claimed is:

1. A connector comprising:

a module, the module configured to mate with a body, the module includes a housing, a seal disposed on the housing, a ring including a skirt is slidably positioned on the module and movable between a first position wherein the seal is covered by the skirt and a second position wherein the seal is exposed, the ring is retained in the first position and configured to move to the second position when engaging the body;

wherein the ring is assembled to the module by a hook formed on the module and a slot formed in the ring.

2. The connector according to claim 1, wherein the ring is retained in the first position by a pin formed on an inner side of the ring that rests against a module wall.

3. The connector according to claim 1 wherein the hook and an upper edge of the slot define the first position.

4. The connector according to claim 1 wherein the hook and a lower edge of the slot define the second position.

5. A connector assembly comprising:

a module, the module including a housing, a seal disposed on the housing, a ring including a skirt is slidably positioned on the module and movable between a first positon wherein the seal is covered by the skirt and a second position wherein the seal is exposed, the ring is retained in the first position; and a body, the body includes a housing, the housing configured to mate with the housing of the module, the seal being disposed between the housing of the module and the housing of the body and wherein the housing of the body engages the ring in the first position and moves the ring to the second position when the module and the base are completely mated;

wherein the ring is assembled to the module by a hook formed on the module and a slot formed in the ring.

6. The connector assembly according to claim 5, wherein the pin engages a ridge formed on the body when the module and body are mated together.

7. The connector assembly according to claim 6, wherein the pin is engages a window formed in the body when the module and body are completely mated.

8. The connector assembly according to claim 5, wherein the ring is retained in the first position by a pin formed on an inner side of the ring that rests against a module wall.

9. The connector assembly according to claim 8, wherein the module wall is flexible.

10. The connector assembly according to claim 9, wherein the module wall is bent out of engagement with the pin by the body when the module and body are mated.

11. A connector assembly comprising:

a module, the module including a housing, a seal disposed on the housing, a ring including a skirt is slidably positioned on the module and movable between a first positon wherein the seal is covered by the skirt and a second position wherein the seal is exposed, the ring is retained in the first position by a pin formed on the ring that engages a flexible module wall; and a body, the body includes a housing, the housing configured to mate with the housing of the module, the seal configured to be in close fitting engagement between the housing of the module and the housing of the body and wherein the housing of the body engages the ring in the first position and moves the ring to the second position when the module and the base are completely mated and upon unmated of the module from the body, the body moves the ring from the second position to the first position;

wherein the ring is assembled to the module by a hook formed on the module and a slot formed in the ring.

12. The connector assembly according to claim 11, wherein the second pin engages a window formed in the body when the module and body are completely mated.

13. The connector assembly of claim 11, wherein a second pin is formed on a flexible portion of the ring that engages a ridge on the body.

14. The connector assembly of claim 13, wherein the flexible portion formed on the ring is adjacent the flexible module wall.

15. The connector assembly of claim 14, wherein the ridge engages the second pin formed on the flexible portion of the ring and deflects the flexible portion of the ring and the flexible module wall and disengages the pin from the flexible module wall when the module is mated with the body.

* * * * *